US007446260B2

(12) United States Patent
Hammonds

(10) Patent No.: US 7,446,260 B2
(45) Date of Patent: Nov. 4, 2008

(54) CORD, CABLE, AND TUBING ORGANIZER

(76) Inventor: Jack Hammonds, 3020 El Cerrito Plz., #336, El Cerrito, CA (US) 94530

( * ) Notice: Subject to any disclaimer, the term of this patent is extended or adjusted under 35 U.S.C. 154(b) by 90 days.

(21) Appl. No.: 11/509,525

(22) Filed: Aug. 24, 2006

(65) Prior Publication Data

US 2006/0283618 A1 Dec. 21, 2006

(51) Int. Cl.
*B65H 39/00* (2006.01)

(52) U.S. Cl. ..... 174/154; 174/135; 174/138 G; 242/388; 439/501

(58) Field of Classification Search ..... 174/154, 174/138 G, 135; 242/388, 388.2, 613.3, 242/405.2; 439/501, 4, 450
See application file for complete search history.

(56) References Cited

U.S. PATENT DOCUMENTS

| | | | | |
|---|---|---|---|---|
| 2,533,341 | A | 12/1950 | Alfano | |
| 3,089,210 | A | 5/1963 | Ritter | |
| 3,924,819 | A | 12/1975 | Lapinskas | |
| 4,586,675 | A | 5/1986 | Brown | |
| 4,705,484 | A | 11/1987 | Lerner et al. | |
| 4,721,268 | A | 1/1988 | Lerner et al. | |
| 4,858,846 | A * | 8/1989 | McDonald | 242/405.1 |
| D376,530 | S | 12/1996 | Hawthorne | |
| 6,012,940 | A | 1/2000 | Wheeler | |
| 6,039,280 | A | 3/2000 | Stephens et al. | |
| 6,142,405 | A | 11/2000 | Black | |
| 6,425,165 | B2 | 7/2002 | Koppang | |
| 6,590,785 | B1 | 7/2003 | Lima et al. | |
| 6,607,169 | B1 | 8/2003 | Gershfield | |
| 6,802,471 | B1 | 10/2004 | Gambrell | |
| 7,172,456 | B1 * | 2/2007 | Nagy | 439/501 |
| 2005/0098699 | A1 | 5/2005 | Schoenmaker et al. | |

* cited by examiner

*Primary Examiner*—Dhiru R Patel
(74) *Attorney, Agent, or Firm*—Kammer Browning PLLC

(57) ABSTRACT

A versatile modular device for organizing, shortening, and securing a plurality of cords such as cables, ropes, strings, lines, tubes and wires, having a simple design which permits easy removal or addition of cords and a straightforward method for wrapping and securing an individual cord to a desired length. The device utilizes a rectangular box design having slotted side panels. The side panel slots are slanted and sized such that a plurality of modular reel bars may be inserted therein, will not slip out accidentally, and may be removed or added without disturbing the other modules. Each reel bar is designed with a plurality of apertures for securing a cord at varying lengths, leaving only the desired amount of cord loose. The device includes an electrical power strip for streamlined electrical power access and may be secured to a desk or table by appropriate attachment means.

7 Claims, 4 Drawing Sheets

CORD, CABLE, AND TUBING ORGANIZER

CROSS REFERENCE TO RELATED APPLICATIONS

This Application claims the benefit under 35 USC §120 of co-pending U.S. patent application Ser. No. 11/078,980 filed Mar. 11, 2005.

BACKGROUND OF THE INVENTION

1. Field of the Invention

The present invention relates generally to organizers for computer cables, electrical cords, and the like. The present invention relates more specifically to a mounting cabinet having a number of slots for inserting and securing individual cord wrapping bars.

2. Description of the Related Art

Some efforts have been made in the past to provide an apparatus which is capable of organizing multiple cords such as those found on a computer system or an entertainment system. These efforts have generally been directed to devices that provide an element for winding, tensioning, or wrapping the cords, cables, or wires in place in order to shorten the amount of cord or cable remaining loose. In general, however, these devices do not provide a simple unit for the secure and precise organization of multiple cords of varying length.

Some of these past efforts include winding reels, such as U.S. Pat. No. 2,533,341 issued to Alfano which is directed to a set of simple reels adapted to take up the slack in electrical cables and prevent unwinding. U.S. Pat. No. 3,924,819 issued to Lapinskas is directed to a spool-like device having a long hub with an outer surface on which a cord may be wrapped, as well as retaining rims and releasable clips for securing the cord. U.S. Pat. No. Des. 376,530 issued to Hawthorne is directed to the ornamental design for a cord organizer container having a number of spools with notched openings above each spool, openings on the side panels of the container, and a cover for the container.

Other prior art devices for cord storage include containers or canisters such as U.S. Pat. No. 4,705,484 issued to Lerner et al. which discloses a canister that includes a protective cover and an internal cylinder around which cords can be wound, having adjustable notched rings capable of holding cords in place. U.S. Pat. No. 4,721,268 issued to Lerner et al. is directed to an organizer consisting of identical elongated containers which can be used singly or attached in multiple units, the combination of which creates a base upon which other objects or small electrical appliances may be placed. U.S. Pat. No. 3,089,210 issued to Ritter is directed to a molded plastic cord holder for shortening and storing the intermediate portions of a cord by winding them around multiple partitions within the device in order to achieve the desired length. U.S. Pat. No. 6,039,280 issued to Stephens et al. is directed to a cable caddy for shortening and housing medical monitor cables in the operating room and at the bedside. The cable caddy includes a base and a number of cable cartridges having a winding surface and, optionally, one or more end flanges with cable grasps.

U.S. Pat. No. 4,858,846 issued to McDonald is directed to a harness to remove slack from coaxial type cables utilized with various electronic components. A container is provided with a number of telescoping heads to orient and secure the cables. Alternatively, spring biased spools may be used to enable a tensioned withdrawal of unused cable from the container. U.S. Pat. No. 6,590,785 B1 issued to Lima et al. is directed to a cable manager that arranges a number of cables which are engaged by bobbins and troughs forming a tray-like structure, wherein the cables may be additionally secured with clips or locks. U.S. Pat. No. 6,607,169 B1 issued to Gershfield is directed to an organizer designed to be attached to a table top, having a base with a cable guide extending at an angle for receiving the cables, and prongs with cable retainers extending upward above the base for guiding and arranging the cables.

While many attempts have been made in the past to provide an apparatus for organizing multiple cords and cables, some of which secure the cords into position, few if any of the devices provide a simple way to precisely shorten cords and/or add or remove individual cords, and at the same time provide frames or enclosures that are compact and easy to handle. Such features are not met by any system described in the prior art. It would be desirable therefore to have a versatile caddy design for power cord organization which includes a simple structure with slots to hold a plurality of bars with means on each bar for securing a cord or cable to a desired length to keep the cable from unwinding. The device should be of modular design wherein the reel components may be used alone or attached in multiple units within the organizer.

SUMMARY OF THE INVENTION

It is therefore an object of the present invention to provide a system that combines a modular concept for storing and organizing cords with a simple design that permits easy removal or addition of cords and a straightforward method for wrapping and securing an individual cord to a desired length. The present invention utilizes a rectangular box design having slotted side panels which are slanted and sized such that a plurality of bars may be inserted therein and will not slip out accidentally. Each modular cord bar is designed with a number of notches for winding and holding a cord in place at varying lengths and allowing the user to leave only the desired amount of cord loose. The user can select the number of bars necessary for the specific components in use. Additionally, each bar can be removed separately to facilitate replacement or reorganization of the individual components without disruption of the other cord bars.

DETAILED DESCRIPTION OF THE PREFERRED EMBODIMENTS

Figure 1:
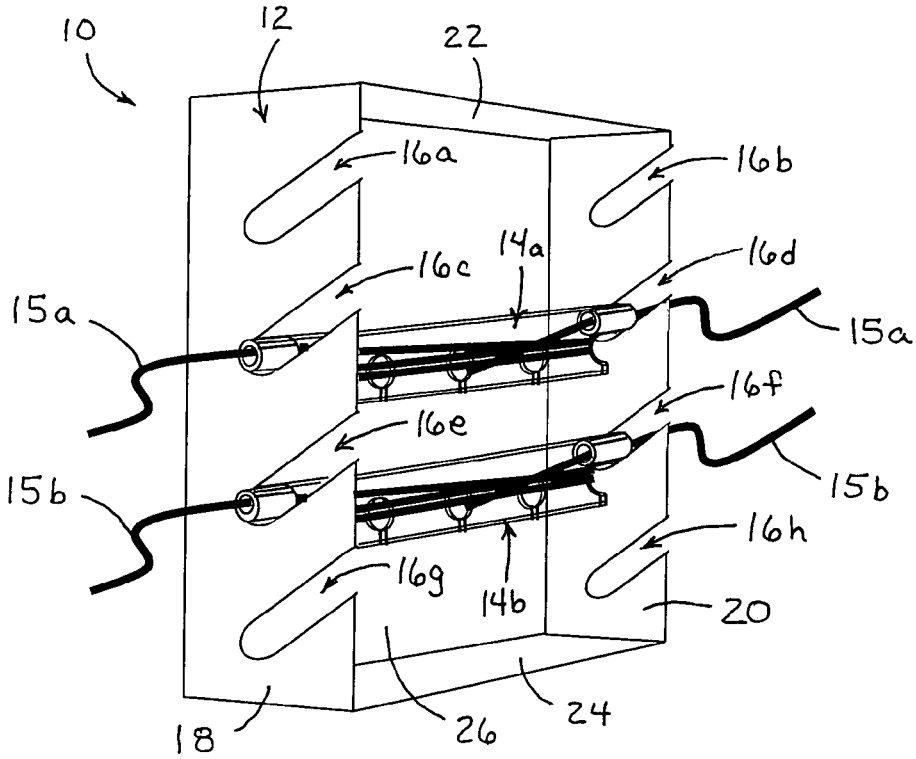
FIG. 1 is a perspective view of the cord organizer of the present invention without the front cover in place.

Reference is made first to FIG. 1 for a brief overall description of the cable organizer apparatus 10 of the present invention. The cabinet frame 12 is generally shaped as a rectangular enclosure having a top frame panel 22, a bottom frame panel 24, and a back frame panel 26. Additionally, a left side panel 18 and a right side panel 20 are slotted with a plurality of angled reel slots 16*a*-16*h* for the insertion of one or more cable reels. Continuing in FIG. 1, a first cable reel 14*a* is shown fitted into angled reel slots 16*c* and 16*d* and a second cable reel 14*b* is shown fitted into angled reel slots 16*e* and 16*f*. A first wire cable 15*a* is wound around first cable reel 14*a* to the desired length and a second wire cable 15*b* is wound around second cable reel 14*b* to the desired length.

Figure 2:
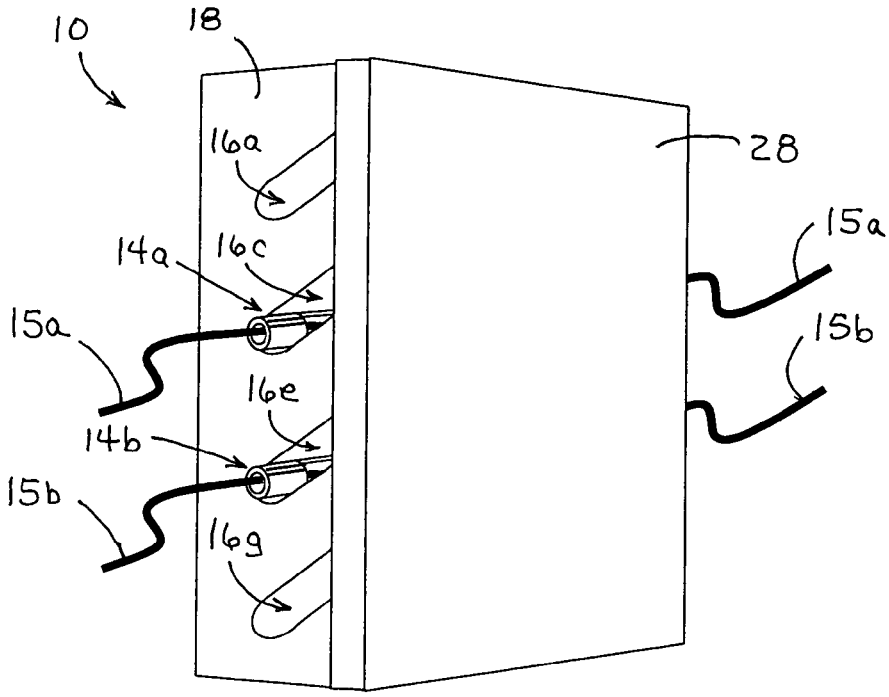
FIG. 2 is a perspective view of the cord organizer of the present invention with the front cover in place.

FIG. 2 illustrates the cable organizer 10 of the present invention with cabinet frame cover panel 28 positioned in place on cabinet frame 12, covering and further securing the cable reels 14*a* and 14*b* (as examples) into the angled reel slots 16*e* and 16*f*. The process of using the present invention involves a number of steps. First, the wire cables are wound around the cable reels to the desired lengths (as described in more detail below). Next, the cable reels are positioned within the angled reel slots. Finally, the cabinet frame cover panel is secured over the cabinet frame to help retain the cable reels within the reel slots and to protect the cables and wires from exposure.

Figure 3A:
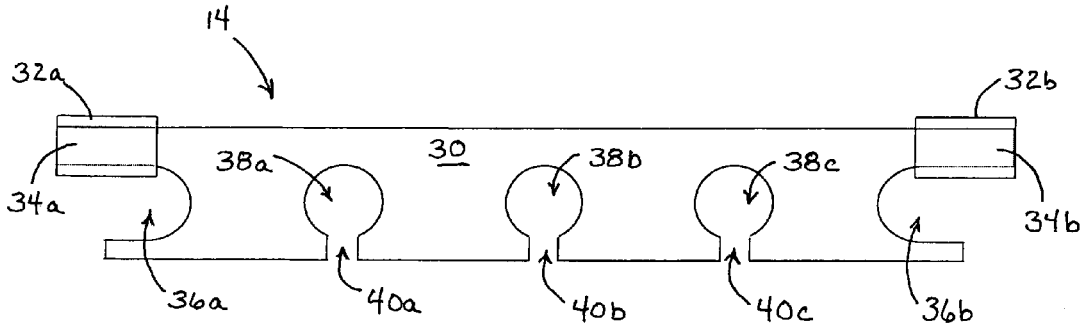
FIG. 3A is a detailed front view of an individual cord reel of the cord organizer of the present invention.
Figure 3B:
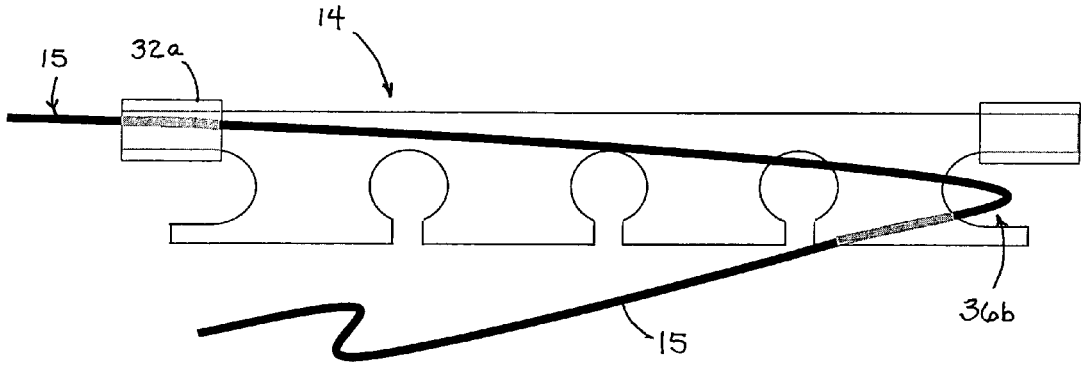
FIG. 3B is a detailed front view of an individual cord reel of the cord organizer of the present invention showing the first step in the method of wrapping a cord on the reel.
Figure 3C:
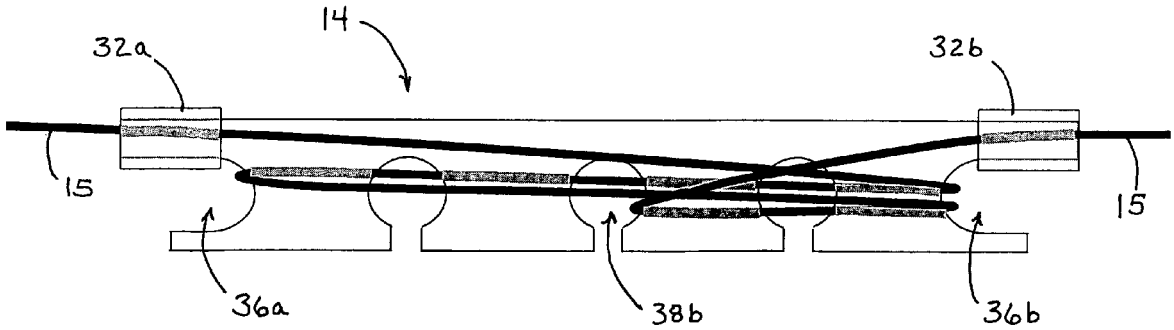
FIG. 3C is a detailed front view of a cord reel of the cord organizer of the present invention showing one configuration of completing the wrapping and securing of a cord on the reel.

Reference is now made to FIGS. 3A, 3B, and 3C which provide detailed front views of a cable reel of the present invention in various stages of being wrapped with a cable. Referring first to FIG. 3A, a representative cable reel 14 is shown in the preferred embodiment with the reel bar 30 having a plurality of winding apertures 38*a*, 38*b*, and 38*c*, as well as aperture slots 40*a*, 40*b*, and 40*c*. At either end of the reel bar 30 are the left side bar horn 34*a* and the right side bar horn 34*b* that fit into the slotted side panels of the cabinet frame 12 as shown above. Adjacent to the bar horns are the left side cable guide 32*a* and the right side cable guide 32*b* through which the cable is secured to the reel bar 30 as it enters and exits the cabinet frame 12. Also located at either end of the cable reel bar 30 are left side bar end slot 36*a* and right side bar end slot 36*b* around which the cable length may be wound. Thus, a wire cable is first secured to the cable reel bar through either the right or left side cable guide (see FIG. 3B). The wire cable is then drawn across and around the cable reel the required number of times and looped through an appropriate aperture slot into the corresponding winding aperture, depending on the length of the excess cable to be wound. The wire cable may be looped around the cable reel side bar end slot, an intermediate aperture slot, or both, as required to achieve the desired cable tension and length.

As shown in FIG. 3B, entering cable 15 is secured to the left side bar horn 34*a* under the left side cable guide 32*a* and wrapped across the reel bar 30 to the right side bar end slot 36*b*. Continuing in FIG. 3C, the cable 15 is wound behind cable reel bar 30 to the left side bar end slot 36*a* and again in front of the reel bar back to the right side bar end slot 36*b*. Upon nearing the appropriate cable length, the cable 15 is wrapped around the reel bar through the half aperture slot 40*b* to the half winding aperture 38*b* and across to the right side bar horn 34*b* where it is secured by the right side cable guide 32*b*, where the cable 15, now shortened to the desired length, exits the cabinet frame 12. The various slots and apertures 40*a*, 40*b*, and 40*c* and 38*a*, 38*b*, and 38*c* are selected for use depending on the cable length and the amount of excess cable remaining for the particular use desired.

Figure 4:
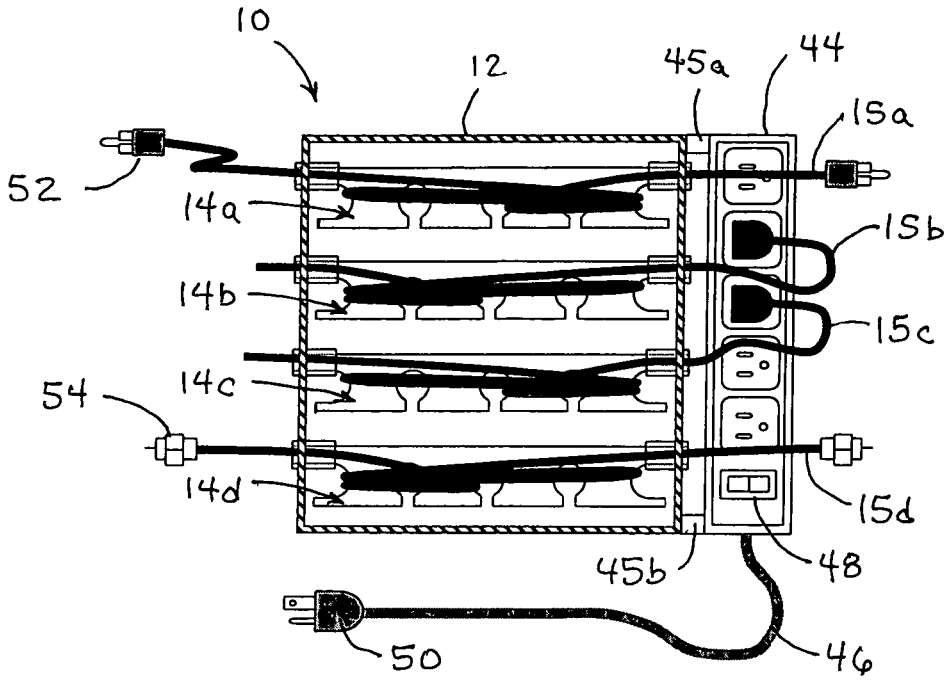
FIG. 4 is a front view of the cord organizer of the present invention without the front cover in place showing an attached electric outlet strip.

FIG. 4 illustrates the cable organizer apparatus of the present invention with the cabinet frame 12 holding a plurality of cable reels 14*a*, 14*b*, 14*c*, and 14*d* and securing a plurality of cables 15*a*, 15*b*, 15*c*, and 15*d* of varying lengths and types (cable 15*a* has an RCA cable plug 52, cables 15*b* and 15*c* are standard power cords, and cable 15*d* has a coaxial cable plug 54). Each cable is secured to a particular reel bar and is attached to a bar horn by a cable guide. The particular cable is then wrapped around the reel bar to the desired length and attached by a cable guide to the bar horn at the opposite end of the reel bar. The reel bar is then inserted into the angled reel slots in the side panels of the cabinet frame as described in more detail below. A plurality of reel bars with associated secured cables may be inserted into the side panels of the cabinet frame.

At one side of the cabinet frame 12 are upper and lower power strip brackets 45*a* and 45*b* which secure an electrical power strip 44 to accommodate the cable electrical power plugs as required. A power strip cord 46 is attached to the electrical power strip 44 near the lower power strip bracket 45*b*. A power strip plug 50 is attached to the distal end of the power strip cord 46 for insertion into an electrical wall outlet. A power strip switch 48 is positioned on the electrical power strip 44 as is known in the art.

Figure 5:
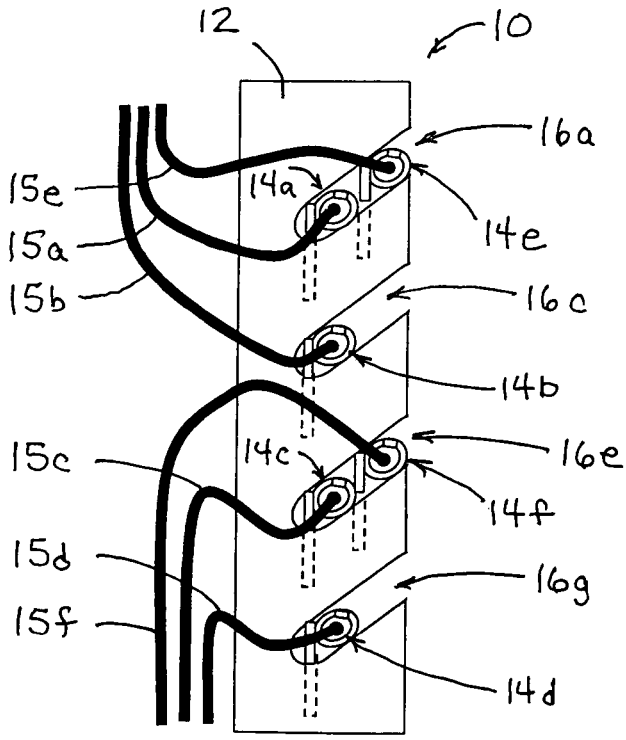
FIG. 5 is a side view of the cord organizer of the present invention showing the placement of the cord reels in the side slots of the organizer.

FIG. 5 illustrates a side view of the cabinet frame 12 of the cable organizer apparatus of the present invention. As shown in FIG. 5, the wire cables 15*a*, 15*b*, 15*c*, 15*d*, 15*e*, and 15*f* are positioned in the cable guides of the cable reels 14*a*, 14*b*, 14*c*, 14*d*, 14*e*, and 14*f* which are positioned within angled reel slots 16*a*, 16*c*, 16*e*, and 16*g* respectively, of cabinet frame 12. An angled reel slot may hold more than one cable reel (i.e., cable reels 14*a* and 14*e* are each positioned within angled reel slot 16*a*, while cable reels 14*c* and 14*f* are each positioned within angled reel slot 16*e*). It is understood that the cable reels shown in FIG. 5 are each supported on an opposite end thereof by the corresponding reel slots on the opposing side slotted panel.

Figure 6:
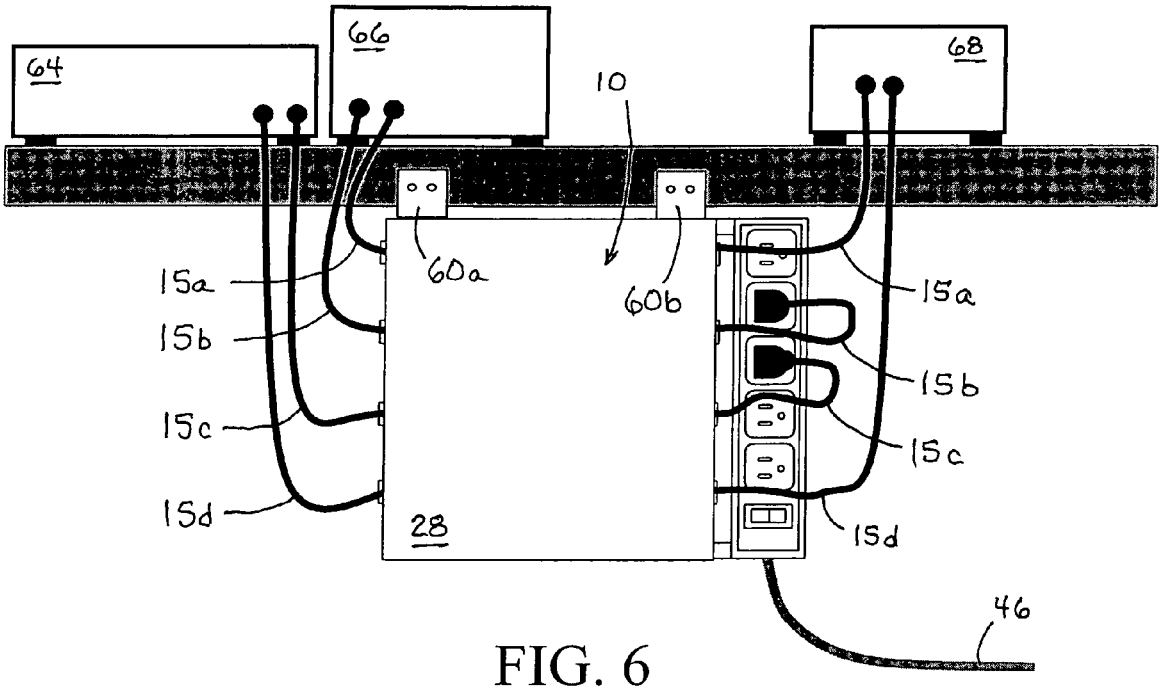
FIG. 6 is a front view of the cord organizer of the present invention showing typical connections to electrical equipment and mounting to a table top.

FIG. 6 illustrates a front view of the cable organizer 10 of the present invention showing typical connections to electrical/electronic equipment and devices (64, 66, and 68). The organizer is shown with the cabinet frame cover panel 28 in position over the cabinet frame 12 and attached to a desk or table top 62 by left side hanger bracket 60*a* and right side hanger bracket 60*b*. The cable organizer provides a versatile solution for arranging and storing multiple wire cables which serve a variety of purposes. As shown in FIG. 6, wire cable 15*a* connects electrical/electronic equipment 66 and 68, while wire cable 15*d* connects electrical/electronic equipment 64 and 68. In this configuration, the wire cable connecting the electrical/electronic devices may be shortened to the desired length by securing either end of the cable with a cable guide and wrapping the excess cable around a cable reel through the desired aperture. Wire cables (15*b* and 15*c*) coming from electrical devices 66 and 64 respectively are power cords in this example and may be connected to the electrical power strip after being secured to the desired length around a cable reel. When all of the wire cables are properly positioned within the cable organizer system, the cabinet frame cover panel 28 is secured to the system and the power strip cord 46 is connected to an electrical outlet.

Figure 7:
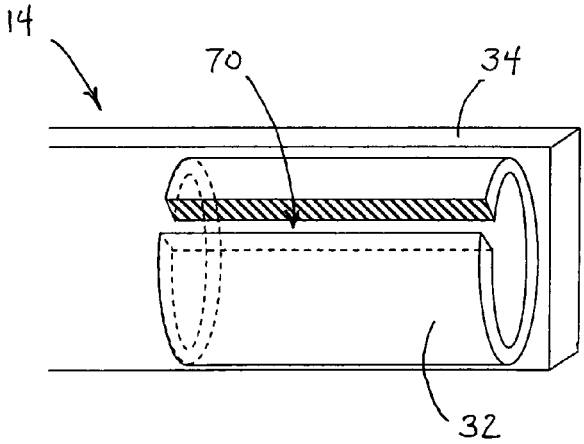
FIG. 7 is a detailed perspective view of the cord holder component of the cord organizer of the present invention.

FIG. 7 illustrates a detailed perspective view of a typical cord holder positioned on each end of each cable reel of the system of the present invention. Specifically, FIG. 7 shows a cable reel 14 having a typical reel bar horn 34 with a typical flex cable guide 32 having cable guide slot 70. The flex cable guide 32 is adhered to the reel bar horn 34 by any of a number of means well known in the art. A wire cable may be inserted through cable guide slot 70 and securely held in position against the cable reel 14 by flex cable guide 32. As shown in FIG. 2 and FIG. 5, the slot configuration of side panels 18 and 20 of cabinet frame 12 helps to "close" cable guide slot 70 as cable reel 14 is pushed into angled reel slot 16. Also, no cutting or abrasion of the wire cable 15 on the side panel occurs because of the protection afforded by the flexible cable guide 32.

It is anticipated that further variations in both the structure and method of use of the device of the present invention will be apparent to those skilled in the art after a reading of the present disclosure and a discernment of the attached drawing figures. Such variations, while not explicitly described and defined herein, may be seen to fall within the spirit and scope of the present invention. For example, but without limitation, the cabinet frame component of the structure of the invention as described is generally shown as rectangular. Those skilled in the art will recognize that alternate structural shapes (such as square) are possible. Likewise, the material from which these component sections might be constructed could be any of a number of rigid or semi-rigid compositions available for such structural elements. Various components may be transparent for optimal appearance, visibility and ease of use. For example, but again without limitation, the cable reels might be constructed of strong plastic or metal components. Those skilled in the art will recognize the balance required between rigidity and flexibility in selecting the most appropriate materials.

Likewise, it is anticipated that the present invention will find use in conjunction with a variety of cable or cord-like structures. To be inclusive in scope, the claims that follow refer to the use of the present invention in connection with "cords," which terminology contemplates a definition that includes "cables, ropes, strings, lines, wires, tubes and similar objects generally characterized by being long, having a small diameter or cross-section, and being flexible."

I claim:

1. A system for retaining and organizing a plurality of cords, the system comprising: a cabinet frame defining an open enclosure and including first and second side panels, each of said side panels defining a plurality of angled reel slots wherein each slot is open at an upper end thereof and each angled reel slot on the first side panel corresponds with an aligned angled reel slot on the second side panel; and at least one longitudinal winding reel having a left side bar horn and a right side bar horn, said left side bar horn removably insertable into and supported by one of the plurality of angled reel slots in the first side panel and said right side bar horn removably insertable into and supported by the aligned angled reel slot in the second side panel; wherein the at least one longitudinal winding reel may be removed from the cabinet frame so as to allow a cord to be wrapped to a desired length around the at least one longitudinal winding reel and may thereafter be positioned within the cabinet frame by insertion of the left side bar horn of the longitudinal winding reel into one of the angled reel slots on the first side panel, and the right side bar horn of the longitudinal winding reel into the aligned angled reel slot on the second panel.

2. The system of claim 1, further including a cabinet frame cover panel sized to fit snugly against said cabinet frame to generally close said open enclosure of said cabinet frame.

3. The system of claim 1 wherein each of said angled reel slots is dimensioned to receive and retain at least two of said winding reels.

4. The system of claim 1 wherein said plurality of angled reel slots comprises four angled reel slots on the first side panel and an aligned four angled reel slots on the second side panel.

5. The system of claim 1, wherein the cabinet frame further comprises:

a power strip bracket; and an electrical power strip connected to the power strip bracket, said power strip containing a plurality of power receptacles for receiving individual wire cable power plugs and additionally including means for supplying electrical power to the power strip.

6. The system of claim 1, wherein said at least one winding reel further comprises:

a left side bar end slot and a right side bar end slot on said reel bar for wrapping a cord to the desired length on said reel bar; a left side guide and a right side guide for securing the cord to the left side bar horn and right side bar horn; and at least one intermediate open winding aperture positioned along the length of the winding reel for receiving and winding the cord to the desired length.

7. The system of claim 1, further including a bracket assembly removably attached to the cabinet frame for mounting said cabinet flume to a desk or table top.

* * * * *